US005890615A

United States Patent [19]

Petras

[11] Patent Number: 5,890,615

[45] Date of Patent: Apr. 6, 1999

[54] PET RESISTANT GARBAGE CAN

[76] Inventor: Ronald J. Petras, 9018 W. Fullerton Ave., River Grove, Ill. 60171

[21] Appl. No.: 725,998

[22] Filed: Oct. 4, 1996

[51] Int. Cl.[6] ..... B65F 1/14

[52] U.S. Cl. ..... 220/23.86; 220/908; 220/264

[58] Field of Search ..... 220/908, 23.83, 220/23.86, 264, 263, 262, 730

[56] References Cited

U.S. PATENT DOCUMENTS

| | | | |
|---|---|---|---|
| 3,389,826 | 6/1968 | Wall | 220/264 |
| 4,809,850 | 3/1989 | Laible et al. | 220/908 |
| 5,361,978 | 11/1994 | Monroe | 220/908 |
| 5,381,921 | 1/1995 | Bray et al. | 220/908 |

FOREIGN PATENT DOCUMENTS

| | | | |
|---|---|---|---|
| 2659945 | 9/1991 | France | 220/908 |
| 1139431 | 11/1962 | German Dem. Rep. | 220/908 |
| 2200153 | 9/1972 | Germany | 220/908 |
| 3333316 | 3/1985 | Germany | 220/908 |
| 1052678 | 12/1966 | United Kingdom | 220/908 |

*Primary Examiner*—Stephen J. Castellano
*Attorney, Agent, or Firm*—Denison & Assocs, PC; JoAnne M. Denison

[57] ABSTRACT

The present invention comprises a tamper resistant garbage or waste container having an exterior housing, an interior bin suitable for receiving waste or garbage, with the interior bin further being provided with a pair of pivoting shafts which extend from either side of the interior bin into the interor of the housing, allowing the entire bin to pivot forward when in use. An additional biasing mechanism is secured to the top of the housing which prevents the bin from pivoting forward when unauthorized access is being attempted. A bias spring is further provided which is attached between the backside of the bin and the interior backwall of the housing, allowing the bin to readily and firmly return to its upright position when not in use.

7 Claims, 1 Drawing Sheet

PET RESISTANT GARBAGE CAN

BACKGROUND OF THE INVENTION

The present invention relates to the area of garbage or waste can improvements, and more specifically is directed towards garbage cans which are made pet resistant by incorporating a foot pedal or handle which is stepped on or pulled by the user while at the same time a biasing mechanism is released in order to allow a trash or garbage containing bin to pivot forward for easy access to the contents thereof.

FIELD OF THE INVENTION

Although there are a number of patents seen in the prior art which deal with trash or garbage cans having foot pedals to open the top of the can or some closure mechanism for a can or bin lid, none of these disclosures is directed toward providing a can with a housing that will be resistant to tampering from even the largest and strongest of dogs. It is well known that all types of domestic pets, from small cats and rabbits to large strong dogs seem to have a penchant for obtaining snacks from the kitchen garbage can and they tend to strew the contents thereof throughout the kitchen and even the house, leaving their owners exasperated with different solutions as to how to make the kitchen garbage can inaccessible. Further, small children can also be a problem with regard to spreading the contents of a trash or garbage receptacle around the house, and there are no waste or garbage cans seen in the prior art which prevent this from occurring. Kitchen garbage may be especially dangerous to small children when they often contain not quite empty cleaning product bottles which can be drunk and/or bits of medicine or other volatile substances which could be very dangerous to ingest. Hence it is highly recommended to keep children away from all garbage that is not simply paper products.

For example, U.S. Pat. No. 5,147,056 issued to Ma discloses a foot actuated opener for a trash bin which supposedly is adaptable to existing trash bins in fast food restaurants wherein the patron can simply step on a foot pedal and place trash therein. However, this device does not have any resistance to pets which can simply nose their way under the swinging door and partake of a snack. It is not particularly resistant to large dogs that would be able to simply push their way into the device Miller, U.S. Pat. No. 5,372,271 discloses a similar device in that it shows a foot pedal mechanism adapted to open the swinging door of a garbage container for a fast food restaurant.

Likewise, U.S. Pat. No. 4,217,073 issued to Propst discloses a down flow material handling system which utilizes a swinging entry door for soiled linen and it is anticipated the entire bin will be lifted and rotated to remove the soiled linen directly from the bottom of the bin, which is hinged and may swing open when desired. The swinging door providing contents to the interior of the bin is not biased and would not be particularly pet resistant.

Similarly, U.S. Pat. No. 5,348,222 issued to Patey discloses a garbage container wherein an interior bin swings forward and a top lid swings open and upwards, allowing for greater access to the bin located therein, however, the top lid is not biased in some manner and again, a large dog could easily nose its way into the contents of the container.

Scholl, U.S. Pat. No. 5,492,238, discloses an improved garbage can which utilizes a container supported on an under structure which may be turned to open a top cover of the can. The can is fastened to a wall or other upright horizontal surface on its back. Nonetheless, the lid can be easily opened, and perhaps more so than a normal foot pedal type can inasmuch as a dog or other pet may simply push against it to turn it to one side.

Hence, no where is seen in the prior art a waste receptacle which is pet resistant, wherein a swinging door or a hinged lid is positively biased against opening from the outside, and where the container is secured within a separate housing to keep dogs, cats and other domestic pets from entering within and spreading garbage throughout the household area.

SUMMARY OF THE INVENTION

The present invention consists of a container or receptacle suitable for holding a quantity of garbage or waste having upstanding sidewalls, a sloped top, a foot pedal or handle extending from the front of the container or receptacle, a pair of shafts extending from either side of the sidewalls of the container or receptacle, a housing having upstanding sidewalls, two apertures adapted to fit the pair of extending shafts depending from the container or receptacle to allow the container to pivot forward when authorized access is desired, mounting means on the housing suitable for attaching the housing to a wall, floor, interior of a cabinet, the underside of a counter, and biased retaining means which prevents the container from pivoting forward when the container is subject to unauthorized access, such as that from a domestic pet or small child. The biased retaining means may consist of either a simple t-shaped flange which extends through an aperture provided in the top of the housing, or a hinged flap may depend downwardly from the tope of the housing and may be biased with a simple spring. The container itself should be provided with biasing means which provides a slight backward force so that it will return to its original upright position after the waste or garbage is deposited. A simple spring may be used for the interior container biasing means to provide a slight backward force.

The container or receptacle itself may be made from plastic, wood or a variety of materials. It is preferably square or rectangular to most efficiently use the space within the housing. The housing may be made from wood or other suitable material, and when it is not installed within a kitchen cabinet, it is best made from an attractive hardwood for an aesthetically pleasing appearance and durability. A housing used within a cabinet may be made from a sturdy rigid plastic. The mounting means may consist of a series of screws extending through corresponding holes in the top or sidewalls of the housing. In such a manner, the housing may be attached to a wall by its sidewalls or back wall, or it may be attached to the underside of a table or counter top wherein a plurality of screws may extend through corresponding holes in the top of the housing.

A foot pedal may be secured to the front of the container for ease of access. Or, a simple handle on the front of the container may be used to simply pull out the pivoting container when in use. Most importantly, some type of securement device should be used so that dogs cannot simply poke their nose into the container to pull it open. Either a wooden or plastic flange extending through the top of the housing and into the container may be used, or a strong spring may be used so that the container snaps shut, should the animal nose its way into the container. Of course, the container should be of a suitable height so that it is difficult for most dogs to directly enter into the container, and it is recommended that the container be standard counter height so that a dog would necessarily need to stand on its hind legs, thus making it much more difficult for the dog to tamper with the contents of the container.

By allowing the container to tip forward, a great deal of access is provided to the authorized user of the container. It is then easy to stuff a large quantity of refuse or waste therein with little effort from the user. The container will snap shut when finished, effectively keeping all unwanted users, such as dogs, cats and small children out. Thus, the device is simple and efficient to use and a great improvement over the prior art.

OBJECTS OF THE INVENTION

Hence, it is a primary object of the instant invention to provide a pivoting garbage or refuse container within a housing which must be opened with a foot pedal or handle and which is further provided with a mechanism against unauthorized opening by domestic pets, especially dogs, and small children.

It is a further primary object of the present invention to provide a pivoting garbage or refuse container within a housing, wherein a five sided housing offers great protection against mauling and tampering of the contents of a garbage or refuse container.

It is a further primary object of the present invention to provide a pivoting garbage or refuse container with a housing that is adapted to attach to a wall, a floor, the underside of a table or counter top, to prevent animals or small children from tipping the container and spilling out the contents.

It is a further primary object of the present invention to provide a pivoting garbage or refuse container with a biasing mechanism such as a spring or a flange extending through the top of the housing and into the interior of the housing which prevents the garbage or refuse container from pivoting forward when unauthorized access is attempted from an animal or small child.

It is a further primary object of the present invention to provide a pivoting garbage or refuse container which tips forward away from a housing so as to provide complete access to the interior of the container.

It is a further primary object of the present invention to provide a pivoting garbage or refuse container which can be readily and easily made from inexpensive materials such as wood or plastic, and which easily attaches to existing surfaces within a kitchen, such as cabinet interiors, a floor or wall or even underside of a counter top.

It is a further primary object of the present invention to provide a pivoting garbage or refuse container which tips forward in use and is provided with a biasing mechanism so that the container readily returns to its original position when not in use.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
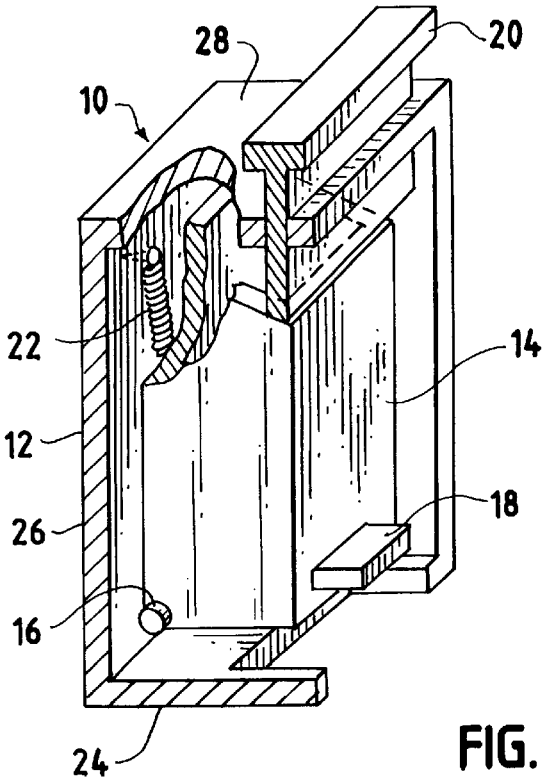
FIG. 1 shows a side view of a preferred embodiment of the present invention with a flange securement means when the container is in its fully closed position.
Figure 4:
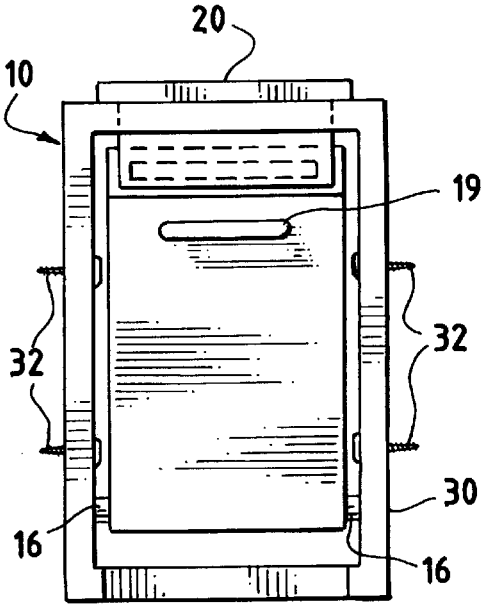
FIG. 4 shows a front view of a second embodiment of the present invention with a flange securement means and a pull handle which accesses the container located therein.

FIG. 1 shows a first preferred embodiment of the present invention of tamper resistant container assembly 10. Tamper resistant container assembly 10 consists of housing 12 which has a housing bottom 24, a housing back wall 26, a housing top 28 and two sidewalls 30 which completely surround and protect bin 14. Thus, the housing 12 is essentially five sided and provides a great deal of protection against unauthorized entry from domestic pets and small children. Bin 14 is further provided with a pair of pivoting shafts 16 which extend from its sidewalls and into corresponding apertures located in the sidewalls 30 (as shown in FIG. 4). In such a manner, bin 14 may be readily tipped forward by an authorized user providing complete access to the interior thereof for easy deposit of large amounts of trash or garbage.

Figure 2:
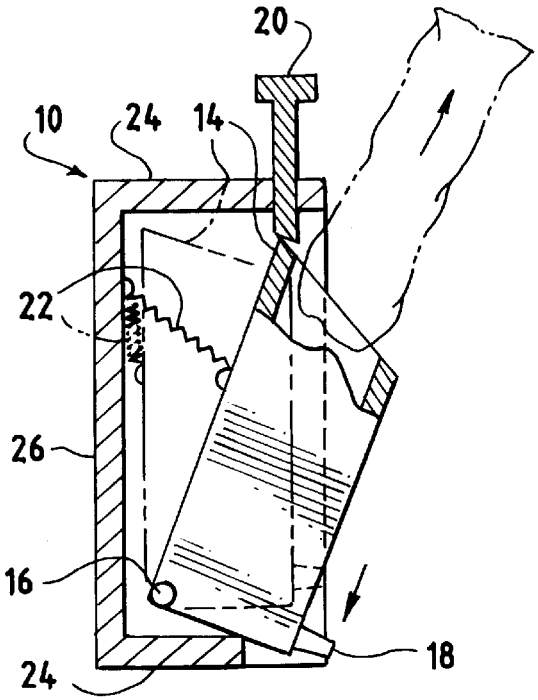
FIG. 2 shows a side view of a preferred embodiment of the present invention with a flange securement means when the container is in its fully open position and the container biasing spring is fully extended.

In the first preferred embodiment shown, a simple foot pedal 18 is used to tip bin 14 forward. However a variety of other bin movement devices, such as pull handle 19 may be utilized to accomplish the same result. A t-shaped securement flange 20 is further utilized to prevent against unauthorized entry from animals and small children. FIG. 2 shows tamper resistant container assembly 10 in use when the bin 14 is in its fully opened position. A sloped top edge is provided for bin 14 which pushes up t-shaped securement flange 20 as the bin 14 is opened with foot pedal 18. A container biasing spring 22 is further provided to upright bin 14 when released by the user so that the bin 14 snaps back when the user is finished depositing garbage therein. The biasing spring 22 is simply attached between the back wall of the exterior of bin 14 to the interior of housing 26.

FIG. 4 shows a front view of tamper resistant container assembly 10 in which a different type of bin is used, handle bin 15 which is provided with a handle 19 located on the front of handle bin 15. In such a manner, handle bin 15 may be simply pulled open by the user. This figure also shows how the housing 12 completely surrounds handle bin 15, making the device especially impenetrable by even large strong dogs. Housing 12 has a bottom 24, a back wall 26 and a top 28, all of which the user may drill holes through when attaching the device securely to a wall, floor or underside of a counter top or table. In this view is also shown how sidewall fasteners may extend through sidewalls 30 so that tamper resistant container assembly 10 may be securely attached to studs where the device is installed in new construction or a remodeling project. It is preferred that tamper resistant container assembly 10 be fastened securely to studs and not with wall anchors due to the rigors of use of a garbage can, and especially one which is used in the vicinity of children or dogs.

Figure 3:
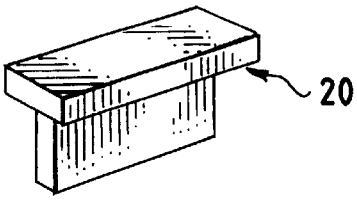
FIG. 3 shows a front view of the t-shaped flange securement means.
Figure 5:
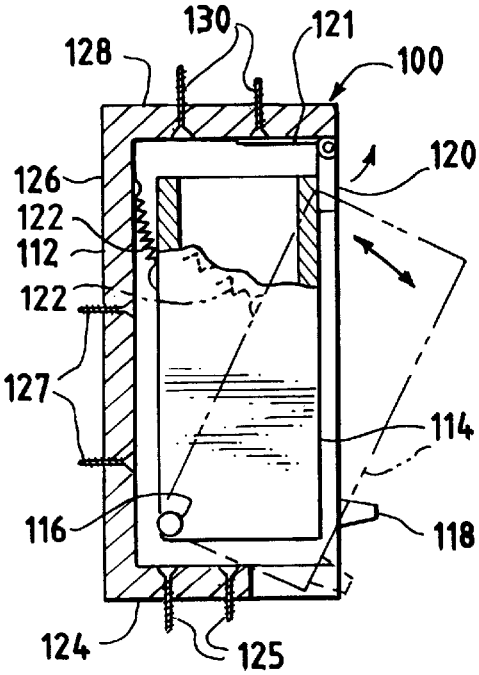
FIG. 5 shows a side view of a third embodiment of the present invention wherein a biasing flap is used to secure the container when not in use.

FIG. 5 shows yet another preferred embodiment of the present invention wherein tamper resistant container assembly 100 is provided with a different biased securement device, entry securement flap or flange 120. Entry securement flap 120 prevents the bin 114 from unauthorized access by pets or small children inasmuch as it is provided with bias spring 121 which securely closes the flap 120 when not in use. Foot pedal 118 is further provided for authorized use. Similarly to the device shown in FIGS. 1, 2 and 3, a pair of shaft pins 116 extend from the sidewalls of bin 114 so that it may easily pivot forward. So that the bin 114 will readily and firmly shut after use, a simple container bias spring 122 is provided which is attached between the back wall of bin 114 and the interior of housing back wall 126.

Also shown in FIG. 5 are a variety of fastening means. For example, top fasteners 130 extend through a plurality of apertures in housing top 128 so that the device may be readily secured to the underside of a counter top or table. Similarly, back wall fasteners 127 extend through a plurality of apertures located in housing back wall 126 so that the device may be readily secured to a wall. As such, bottom fasteners 125 extend through a plurality of apertures in housing bottom 124 so that the device may be secured to the floor. Proper securement of the device is important because pets and children often tip over garbage cans and containers to gain access to the contents therein.

A wide variety of readily available materials may be used for construction of the device and its components. For example, if the tamper resistant garbage can is to be entirely secured within a cabinet, it may be made from plastic inasmuch as it will be hidden substantially from view. Ease of manufacturing and economy make such a material highly desirable to the consumer. However, when the tamper resistant garbage can will be in full view, it is probably advisable to make the housing from a durable and attractive hardwood. If it is to be free standing, it may be attached to the floor. Even the interior bin may be given a hardwood front to create an aesthetically pleasing appearance. Or, where a modern look is desired, the device may be made from stainless steel or an attractive color of enamel. In any case, a tamper proof garbage can is especially desirable for many persons who have pets and small children.

What is claimed is:

1. A tamper resistant waste container having;

a housing having an interior and a top with an aperture;

an interior bin suitable for receiving waste or garbage with a pair of shafts extending therefrom;

the interior of the housing being further provided with corresponding apertures or bores adapted to receive the shafts allowing the interior bin to pivot forward;

a foot pedal or handle for pivoting the bin forward when in use and, biasing means which extends through the aperture in the top of the housing which prevents the interior bin from pivoting forward when unauthorized use is being attempted.

2. The tamper resistant waste container of claim 1 wherein the biasing means comprises a t-shaped flange.

3. The tamper resistant waste container of claim 1 further having a bin biasing mechanism between the bin and the housing wherein the bin automatically returns to an upright position after use.

4. The tamper resistant waste container of claim 3 wherein the bin biasing mechanism comprises a length of spring.

5. The tamper resistant waste container of claim 2 wherein the bin is further provided with a top which slopes downward and the t-shaped flange also slopes downward so that the t-shaped flange rises upwards when the bin is accessed by an authorized user.

6. The tamper resistant waste container of claim 1 wherein the housing is provided with a plurality of apertures adapted to fit fasteners for the purpose of fastening the tamper resistant waste container to a wall, floor or stud so that the bin may not be tipped over.

7. A tamper resistant waste container having;

a housing having an interior;

an interior bin suitable for receiving waste or garbage with a pair of shafts extending therefrom;

the interior of the housing being further provided with corresponding apertures or bores adapted to receive the shafts allowing the interior bin to pivot forward;

a foot pedal for pivoting the bin forward when in use and, biasing means comprising on entry flap and a bias spring mounted to the interior of the housing, wherein the bias spring biases the entry flap against the bin to prevent unauthorized use.

* * * * *